United States Patent [19]

Miller

[11] Patent Number: 5,061,011

[45] Date of Patent: Oct. 29, 1991

[54] CHAISE LOUNGE WITH STABILIZER RODS

[75] Inventor: Robert H. Miller, Schaumburg, Ill.

[73] Assignee: NuZip Dee Manufacturing Company, Inc., Elk Grove Village, Ill.

[21] Appl. No.: 544,961

[22] Filed: Jun. 28, 1990

[51] Int. Cl.[5] ..... A47L 16/00

[52] U.S. Cl. ..... 297/438; 297/436

[58] Field of Search ..... 297/19, 20, 21, 232, 297/233, 250, 251, 252, 253, 254, 255, 256, 423, 428, 429, 430, 431, 432, 433, 463, 436, 438, 22, 23, 24, 25, 26, 27, 28; 248/188.6, 188.91, 302, 303, 304, 227, 251

[56] References Cited

U.S. PATENT DOCUMENTS

| | | | |
|---|---|---|---|
| 144,441 | 11/1873 | Cartwright | 297/433 |
| 518,644 | 4/1894 | Clark | 297/436 |
| 1,185,482 | 5/1916 | Cockerville | 297/250 |
| 2,530,239 | 11/1950 | Gillis et al. | 297/251 |
| 4,345,793 | 8/1982 | Duda | 297/438 |

FOREIGN PATENT DOCUMENTS

| | | | |
|---|---|---|---|
| 587322 | 9/1931 | Fed. Rep. of Germany | 297/250 |
| 547832 | 4/1932 | Fed. Rep. of Germany | 297/432 |
| 583334 | 10/1924 | France | 297/432 |
| 569155 | 2/1957 | Italy | 297/439 |
| 176595 | 1/1934 | Switzerland | 297/19 |

*Primary Examiner*—Kenneth J. Dorner
*Assistant Examiner*—James M. Gardner
*Attorney, Agent, or Firm*—Emrich & Dithmar

[57] ABSTRACT

A chaise lounge including a chair having a back, a seat generally perpendicular to the back, and front and rear leg assemblies at opposite ends of the seat, each of said front and rear leg assemblies having two upstanding spaced apart portions. A lounge member including a rectangular frame member having two parallel spaced-apart and longitudinally extending elongated members and a stabilizing rod connected between each one of the parallel spaced-apart and longitudinally extending elongated members and the associated one of the front leg portions for stabilizing the chair and the lounge member when connected each of said stabilizing rods being pivotally connected at one end to the associated one of said parallel spaced-apart and longitudinally extending members and connected at an opposite end to the associated one of said front leg portions with a hook portion that extends behind and around the associated leg.

14 Claims, 1 Drawing Sheet

CHAISE LOUNGE WITH STABILIZER RODS

BACKGROUND OF THE INVENTION

This invention relates to a chaise lounge and, more particularly, to rods for stabilizing a chaise lounge comprising a chair and a separate lounge member.

A chaise lounge comprising a chair and a separate lounge member is disclosed in U.S. Pat. No. 4,345,793, issued Aug. 24, 1982. The chaise lounge disclosed therein includes a chair and a lounge member which are coupled together by a pair of hooks permanently secured to the rear end of the lounge member and connected to the front end of the chair.

Although the chair and the associated lounge disclosed in the prior patent have been sold for the last eight years and have been commercially successful and satisfactory for their intended purpose, there is one problem that has not heretofore been solved.

Since the chaise lounge is comprised of two separate members, if excess weight or pressure is applied to the chaise lounge in the region thereof where the chair and the lounge member are connected, the chaise lounge may undesirably become unstable or buckle at the connection region due to the lack of support thereat.

This problem, although existing for the past eight years, has not satisfactorily been solved until the present invention.

SUMMARY OF THE INVENTION

The principal object of the present invention is to enhance the stability of a chaise lounge comprising a chair and a separate lounge member.

Another object of the present invention is to provide a chaise lounge comprising a chair, a lounge member having means for connection to the chair, and means for stabilizing the chair and the lounge member when the chair and the lounge member are connected.

And to do so in a manner that can be readily adapted to all prior chairs without modification of the chair and to provide a stabilizing device that can be easily adapted to existing lounge members.

According to the present invention, the chair includes a back, a seat generally perpendicular to the back, and front and rear leg assemblies at opposite ends of the seat, the front and rear leg assemblies having two upstanding front and rear leg portions respectively, a lounge member including a rectangular frame member, a leg assembly at one end of the frame member, and means for connection to the chair at the other end, and means for stabilizing the chair and the lounge member as a unit when the chair and the lounge member are connected, the stabilizer means interconnecting the rectangular frame member and the front leg assembly.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
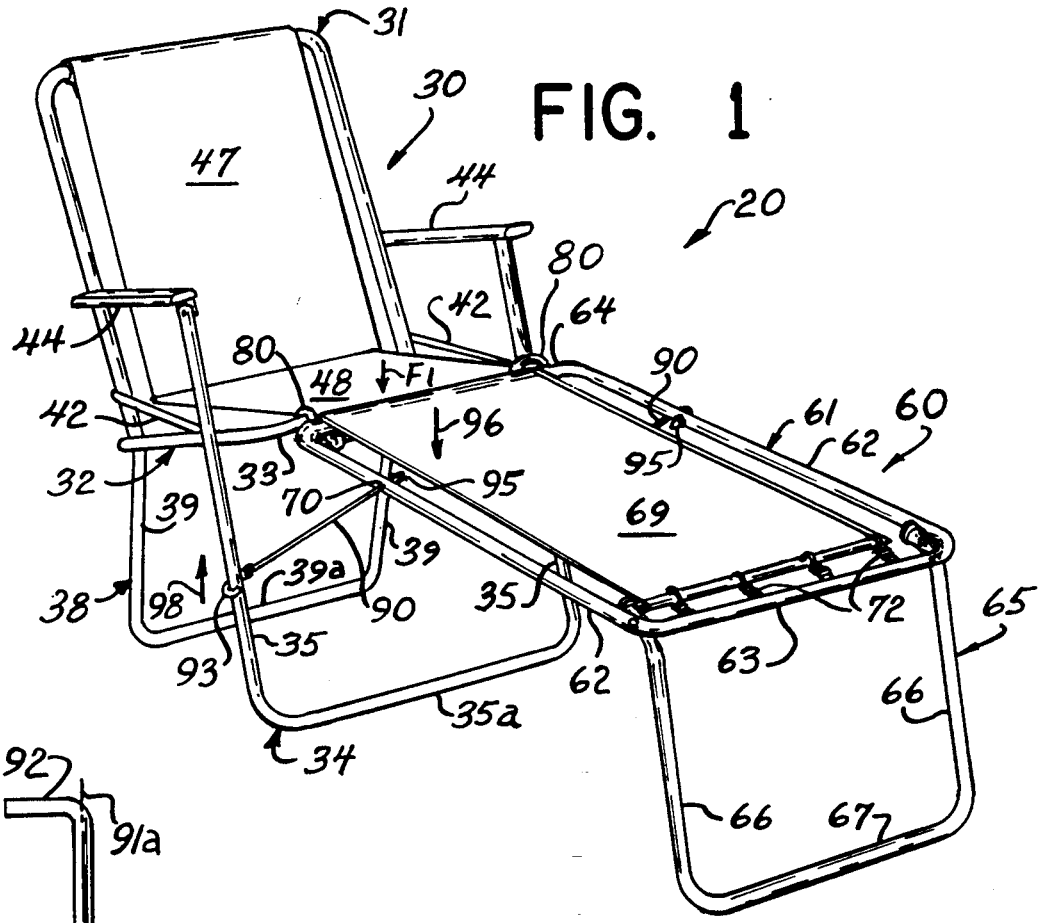
FIG. 1 is a perspective view of a chaise lounge including the stabilizer rods of the present invention.

Referring now to the drawings and, more particularly, FIG. 1, there is disclosed a chaise lounge 20 comprised of a folding chair 30 and a lounge member 60. Although a folding chair is illustrated, the invention is likewise useful with a settee or non-folding furniture.

The folding chair 30 includes a generally rectangular tubular back frame 31 connected to a generally rectangular tubular seat frame 32 having a front piece 33. A U-shaped front leg assembly 34 having two upstanding front leg portions 35 interconnected by a bight portion **35*a* is pivotally connected to the tubular seat frame 32. Additionally, a U-shaped rear leg assembly 38 having two upstanding rear leg portions 39 interconnected by a bight portion 39*a* is pivotally connected to the tubular seat frame 32. Each of two parallel braces 42 is pivotally mounted to the associated portion of the back frame 31 and the seat frame 32, thereby completing the connection of the back frame 31 and the seat frame 32**.

The chair 30 also includes two arm rests 44, each pivotally connected to the associated portion of the tubular back frame 31 and to the end of the associated leg portion 35. Fabric or other suitable material 47 extends over the tubular back frame 31 and fabric or other suitable material 48 extends over the tubular seat frame 32.

The lounge member 60 includes a generally rectangular frame 61 having two parallel spaced-apart side members 62 interconnected by end members 63 and 64. An aperture 70 extends through each of the members 62. The lounge member 60 additionally includes a U-shaped leg assembly 65 having spaced-apart legs 66 interconnected by a bight 67, each of the legs 66 at the end thereof being pivotally mounted to the frame 61. The end of each leg 66 is angularly disposed with respect to the rest of the leg 66 and serves to provide a support surface for the frame 61 and particularly the front member 63 thereof when the leg assembly 65 is pivoted to the support position. The leg assembly 65 is movable from the illustrated support position, wherein the frame 61 rests on the leg assembly 65 to a storage position (not shown) wherein the leg assembly 65 is pivoted such that the leg assembly 65 lies adjacent and substantially parallel to the frame 61. The frame 61 is provided with fabric or other suitable material 69. Coil springs 72 resiliently connect the fabric 69 to the end member 63 of the frame 61. The other end of the fabric 69 passes around the other end member 64 of the frame 61 and is connected to the frame 61 by means not shown.

The chair 30 and the lounge member 60 are coupled to each other by a pair of hooks 80 which are pivotally secured around opposite ends of the other end member 64 of the frame 61 and hooked onto opposite ends of the front piece 33 of the seat frame 32, as previously disclosed in the '793 patent.

According to the present invention, the chaise lounge 20 additionally comprises two rods 90 for stabilizing the chair 30 and the lounge member 60 when the chair 30 and the lounge member 60 are connected together.

Figure 2:
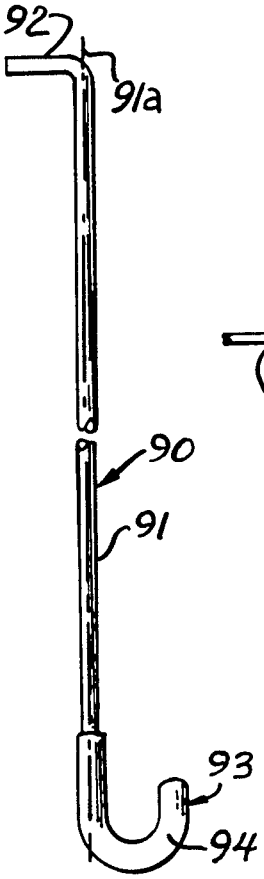
FIG. 2 is a broken plan view of one of the stabilizer rods of the present invention.

As shown in FIG. 2, each of the rods 90 include an elongated portion 91 defining a longitudinal axis 91*a*, a finger or pivot 92 at one end of the elongated portion 91 and a hook 93 at the opposite end of the elongated portion 91. The finger 91 is bent at an angle of approximately 90° to the longitudinal axis 91*a*. A jacket 94 comprised of plastic or other suitable material surrounds the hook 93. The finger 92 and the hook 93 are coplanar and extend from opposite ends of the elongated portion 91. As shown in FIG. 2, the finger 92 is 180° rotated from the hook 93.

Figure 3:
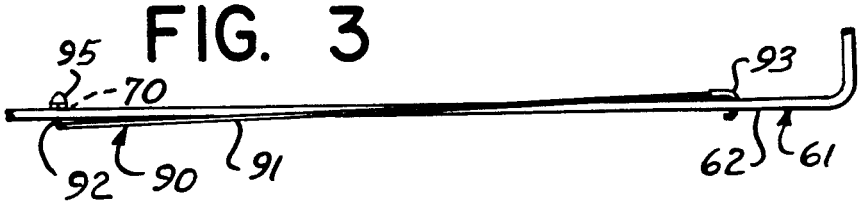
FIG. 3 is a plan view of one of the stabilizer rods connected to the associated member of the rectangular frame of the lounge member and positioned in a storage or shipping position.

As shown in FIGS. 1 and 3, each of the rods 90 is pivotally connected to the associated one of the spaced-apart side members 62 of the frame 61. More particularly, the finger 91 on each of the rods 90 extends through the aperture 70 in the associated one of the spaced-apart side members 62. A nut or other suitable fastener 95 or other suitable fastener is secured to the finger 91 to provide pivotal connection of the rods 90 to the spaced-apart side members 62.

Each of the stabilizer rods 90 is pivotable between a storage or shipping position (FIG. 3) and a stabilizer position (FIG. 1). In the storage or shipping position, the rod 90 is positioned such that the elongated portion 91 thereof is generally adjacent and parallel to the side member 62 and the hook 93 is engaged below the member 62. Frictional engagement between the jacket 94 on the hook 93 and the side member 62 and resilient pressure of the rod prevents the rod 90 from inadvertently disengaging itself from the side member 62 while the lounge member 60 is in storage. Although not shown, it is understood that the rod 90 on the opposite side member 62 is secured in a storage position in a similar manner as that shown in FIG. 3.

After the lounge member 60 is connected to the chair 30 by means of the hooks 80, the rods 90 are unclipped or disengaged from the side members 62 and rotated upwards and around the aperture 70 towards the upstanding front leg portions 35 of the front leg assembly 34. Thereafter, the rods 90 are secured to the chair 30 in a manner such that the hook 93 on each of the rods 90 surrounds the associated one of the upstanding front leg portions 35. After the rods 90 are secured to the leg portions 35, they are prevented from moving therealong because at the angle of the rod 90 and the tension in the rod and further due to the frictional engagement between the jacket 94 and the associated front leg portion 35; however, it is important that the hook 93 contact the associated leg 35 at a point closer to the bight 35*a* than to seat frame 32.

The stabilizer rods 90 of the present invention effectively prevent the chaise lounge 20 from buckling in the region where the chair 30 and the lounge member 60 are connected together.

If the rods 90 are not connected to the upstanding leg portions 35 of the front leg assembly 34, the application of an excess weight, pressure, or force (represented by $F_1$ in FIG. 1) in the region where the chair 30 and the lounge member 60 are connected together tends to cause the front piece 33 of the seat frame 32 and the end member 64 of the frame 61 to tilt in the direction of arrow 96. The tilting then causes the leg assembly 65 of the lounge member 60 slide away from the chair 30 as the end 64 dips toward the ground while the rear leg assembly 38 of the chair 30 to be raised away from the resting surface in the direction of arrows 96 and 98, respectively. Due to the force $F_1$ and the resultant movement of the end member 64 and the rear leg assembly 38 away from the resting surface, the chair 20 is thus caused to tilt and the chair and lounge assembly becomes unstable.

When the stabilizer rods 90 are secured to the upstanding front leg portions 35 as shown in FIG. 1, the front piece 33 of the seat frame 32 and the end member 64 of the frame 61 are effectively prevented from tilting in the direction of arrow 96. As a result, the leg assembly 38 of the chair 30 is prevented from being raised away from the resting surface and lounge frame 61 is prevented from moving away from the chair leg 35, thereby preventing the buckling of the chaise lounge 20 and insuring the overall stability thereof. It is important that the angle between the rod 90 and the associated front leg portion 35 is greater than 45° and preferably nearer to 90° as possible to prevent the rod 90 from slipping along the leg portions 35.

While there has been described what at present is considered to be the preferred embodiment of the present invention, it will be apparent to those skilled in the art that various modifications and alterations may be made herein without departing from the true spirit and scope of the invention. It is intended that all such variations and modifications are to be covered in the claims appended hereto.

I claim:

1. A chaise lounge comprising: a chair including a back, a seat generally perpendicular to said back, and front and rear leg assemblies at opposite ends of said seat; each of said front and rear leg assemblies having two upstanding leg portions with said front leg portions extending angularly forwardly from said seat, a lounge member including a generally rectangular frame member including two parallel spaced-apart and longitudinally extending members, a leg assembly at one end of said frame member, and means for connection to said chair at the other end; and means for stabilizing said chair and said lounge member when said chair and said lounge member are connected, said stabilizer means including two rods each connected between one of said front leg portions and one of said spaced-apart longitudinally extending members, each stabilizing rod having pivot means thereon being connected to the associated one of said parallel spaced-apart longitudinally extending members and having hook means connected to the associated one of said front leg portions wherein said hook means extends behind the associated leg portion such that downward force at the connection between said seat and said lounge member causes said stabilizing rods to be under tension.

2. The chaise lounge of claim 1, wherein each of said pivot means is a finger at one end of said rod bent at an angle of approximately 90° to said longitudinal axis of said associated rod, each of said parallel spaced-apart longitudinally extending members having an aperture located so as to create an angle greater than 45° between said rod and the associated leg portion for receiving one of said fingers, and further comprising means connected to said finger on each of said rods for securing each of said rods to the associated one of said parallel spaced-apart longitudinally extending members.

3. The chaise lounge of claim 1, wherein said hook means is a hook portion of said rod having a jacket surrounding said hook portion for providing frictional engagement between said jacket and the associated one of said front leg portions, thereby preventing each of said rods from moving along the length of the associated one of said front leg portions.

4. The chaise lounge of claim 1, wherein said pivot means is a finger portion of said rod bent at an angle of approximately 90° to the longitudinal axis thereof, and said hook means is a hook, said finger and said hook on each of said rods being generally co-planar and on opposite sides of the longitudinal axis.

5. A chaise lounge comprising: a chair including a back, a seat generally perpendicular to said back, and front and rear leg assemblies at opposite ends of said seat, each of said front and rear leg assemblies having two upstanding spaced apart portions; a lounge member including means for connecting said lounge member to said chair, said lounge member including a rectangular frame member having two parallel spaced-apart and longitudinally extending elongated members; and a stabilizing rod connected between each one of said parallel spaced-apart and longitudinally extending elongated members and the associated one of said front leg portions for stabilizing said chair and said lounge member, each of said stabilizing rods being pivotally connected at one end to the associated one of said parallel spaced-apart and longitudinally extending members and connected at an opposite end to the associated one of said front leg portions such that the angle between the stabilizing rod and the front leg portion is greater than 45°, wherein opposite ends of each of said rods have pivot means and hook means respectively, each of said pivot means being connected to the associated one of said parallel spaced-apart and longitudinally extending members and each of said hook means being connected to said front leg portions by extending around and behind said front leg portions such that downward force at the junctive of said seat and said lounge member causing said rods to be under tension.

6. The chaise lounge of claim 5, wherein said pivot means and said hook means comprises a finger and a hook respectively, each of said parallel spaced-apart and longitudinally extending members having an aperture for receiving one of said fingers and further comprising means connected to said finger on each of said rods for securing each of said rods to the associated one of said parallel spaced-apart and longitudinally extending member.

7. The chaise lounge of claim 6, wherein said finger and said hook on each of said rods are generally co-planar and on opposite sides of the longitudinal axis of each of said rods.

8. The chaise lounge of claim 7, wherein said finger on each of said rods is bent at an angle of approximately 90° to the longitudinal axis of the associated rod.

9. The chaise lounge of claim 6, further comprising a jacket surrounding said hook on each of said rods for providing frictional engagement between said jacket and the associated one of said front leg portions, thereby preventing each of said rods from moving along the length of the associated one of said front leg portions.

10. A chaise lounge comprising: a chair including a back, a seat generally perpendicular to said back, and front and rear leg assemblies at opposite ends of said seat, said front and rear leg assemblies having two front and rear leg portions respectively; a lounge member including means for connecting said lounge member to said chair member, said lounge member including a rectangular frame member having two parallel spaced-apart and longitudinally extending members; and a rod connected between each of said parallel spaced-apart and longitudinally extending members and the associated one of said front leg portions for stabilizing said chair and said lounge member, each of said rods including pivot means and hook means at opposite ends thereof, said pivot means being connected to the associated one of said spaced-apart members, each of said rods being pivotable between a first position wherein each of said rods is generally parallel to the associated one of said spaced-apart members and said hook means engage the associated one of said spaced-apart members and a second position wherein each of said rods is connected to the associated one of said upstanding front leg portions and forming an angle greater than 45° therewith and said hook means extends around and behind the associated one of said upstanding front leg portions to provide stability between said chair and said lounge member.

11. The chaise lounge of claim 10, wherein said pivot means and said hook means comprise a finger and a hook, respectively, each of said parallel spaced-apart and longitudinally extending members having an aperture for receiving one of said fingers and further comprising means connected to said finger on each of said rods for securing each of said rods to the associated one of said spaced-apart members.

12. The chaise lounge of claim 11, wherein said finger and said hook on each of said rods are generally co-planar and on opposite sides of the longitudinal axis of said rods.

13. The chaise lounge of claim 11, wherein said finger on each of said rods is bent at an angle approximately 90° to the longitudinal axis of each of said rods.

14. The chaise lounge of claim 11, further comprising a jacket surrounding said hook on each of said rods for providing frictional engagement between said jacket and the associated one of said front leg portions, thereby preventing each of said rods from moving along the length of the associated one of said front leg portions.

* * * * *